US005430957A

United States Patent [19]

Eigen et al.

[11] Patent Number: 5,430,957

[45] Date of Patent: Jul. 11, 1995

[54] INSTALLATION AND PROCESS FOR THE TEMPERATURE CONTROL OF CHEMICAL AND/OR BIOCHEMICAL AND/OR MICROBIOLOGICAL SUBSTANCES

[75] Inventors: Manfred Eigen, Göttingen; Wolfgang Simm, Rosdorf; Roderich Weise, Göttingen, all of Germany

[73] Assignee: Max-Planck-Gesellschaft zur Förderung der Wissenschaften e.V., Germany

[21] Appl. No.: 30,046

[22] PCT Filed: Sep. 6, 1991

[86] PCT No.: PCT/DE91/00704

§ 371 Date: Mar. 10, 1993

§ 102(e) Date: Mar. 10, 1993

[87] PCT Pub. No.: WO92/04979

PCT Pub. Date: Apr. 2, 1992

[30] Foreign Application Priority Data

Sep. 13, 1990 [DE] Germany ..... 40 29 004.2

[51] Int. Cl.[6] ..... F26B 7/00

[52] U.S. Cl. ..... 34/423; 34/519; 34/68; 34/236

[58] Field of Search ..... 34/30, 39, 202, 33, 34/236, 423, 519, 493, 498, 500, 60, 68, 418

[56] References Cited

U.S. PATENT DOCUMENTS 4,778,143 10/1988 Koshiba .

FOREIGN PATENT DOCUMENTS 0094458 5/1972 European Pat. Off. .
0130905 6/1984 European Pat. Off. .
0151781 12/1984 European Pat. Off. .
05947 5/1990 European Pat. Off. ..... 34/30
3441179 11/1984 Germany .
WO9005023 5/1990 WIPO .
WO9005947 5/1990 WIPO .

*Primary Examiner*—Denise L. Gromada
*Attorney, Agent, or Firm*—Harness, Dickey & Pierce

[57] ABSTRACT

A device (10) for tempering substances has a metal block arrangement (12) with at least one zone (32) the temperature of which can be set at a determined mean value, as well as at least another zone (32'). The device (10) has a metallic base plate (31) with a receptacle for the substances, and at least one of its outer surfaces can be brought into thermal contact with the metal block arrangement (12). In addition, a pressure generator (49) generates a pressure that deviates from the ambient pressure between at least one outer surface and the metal block arrangement. The device (10) further has a conveyor (33) that selectively conveys the base plate (31) into one of the zones (32, 32') of the metal block arrangement (12) along a conveying path (44). The pressure generator (49) is capable of generating an overpressure or a depression. In addition, the conveyor (33) has a member (40) that can be brought to bear against the base plate (31), so that a thrust directed mainly along the conveying path (44) can be exerted on the base plate (31).

20 Claims, 7 Drawing Sheets

INSTALLATION AND PROCESS FOR THE TEMPERATURE CONTROL OF CHEMICAL AND/OR BIOCHEMICAL AND/OR MICROBIOLOGICAL SUBSTANCES

The invention relates to an installation for the temperature control of chemical and/or biochemical and/or microbiological substances comprising

- a metal block arrangement having at least one region which can be set to an average temperature that can be pre-determined, as well as at least one further region,
- a metal support plate, which has a receiving device for receiving the substances and/or for receiving vessels for the substances and can be brought into thermal contact via at least one of its outer surfaces with the metal block arrangement,
- a pressure-generating device, in order to generate, between the at least one outer surface and the metal block arrangement, a pressure which deviates from the ambient pressure and
- a transport device, which transports the support plate along a transport path into one of the regions of the metal block arrangement, as desired.

An installation of this type is disclosed in WO-A-9005947.

The invention also relates to a process for the temperature control of chemical and/or biochemical and/or microbiological substances comprising the steps of:

a) setting at least one region of a metal block arrangement to a pre-determined temperature, b) placing the substances or vessels containing the substances in at least one recess provided in a metal support plate, it being possible to bring the support plate, via at least one of its outer surfaces, into thermal contact with the metal block arrangement, c) transporting the support plate into the at least one region and d) generating a partial vacuum between the outer surface of the support plate and the metal block arrangement in order to improve the thermal contact.

A process of this type is carried out using the installation disclosed in WO-A-9005947.

The metal block arrangement in the known installation is a metal rail which has a U-shaped cross-section and is cooled at one of its ends and heated at its other end. In this way, an approximately linear temperature gradient, the slope (K/cm) of which is determined by the spatial distance and the temperature difference between the two thermostat-controlled ends of the metal rail, is produced in the metal rail.

In addition, it is known to provide additional temperature-control devices between the temperature-controlled ends of the metal rail, in order to produce sections having temperature gradients of different slopes along the metal rail. By this means, for example, temperature regions with a relatively flat temperature gradient and/or temperature regions with a very steep temperature gradient are produced.

The known installation also has a support plate arranged between the legs of the metal rail, which support plate is provided with bores to receive plastic reaction vessels in which the substances to be temperature-controlled are placed. The support plate is transported by means of a transport device into the region of the metal rail which has the desired temperature that the substances are to assume. To ensure the heat exchange required for this purpose, the support plate is in thermal contact via its bottom surface and its two front faces with the base and, respectively, the inner surfaces of the legs of the U-shaped metal rail.

On either side of the support plate two toothed belts are attached which are passed via deflection pulleys in the longitudinal direction of the metal rail around the latter and are each driven via a toothed wheel in such a way that they can pull the support plate backwards and forwards in the U of the metal rail in order thus to move it to different temperature regions.

In order to improve the thermal contact between the support plate and the metal rail it is proposed in the case of the known installation to draw the support plate against the metal rail by suction, by applying a partial vacuum.

A disadvantage of the known installation is that the support plate, which is very high compared with its longitudinal extent, very easily tips when being pulled into a different temperature range, so that the transport of the support plate can proceed only very slowly. Moreover, when overcoming high temperature gradients it frequently occurs that the front faces of the support plate jam between the legs of the U-shaped metal rail because of the expansion associated with the change in temperature, so that no further transport is possible. The operators must intervene manually, in order to make the transport device moveable again.

Because the speed with which the support plate travels is only slow, the times which are needed to change the temperature of the substances transported with the plate is undesirably high, particularly in the context of modern biochemical methods.

Moreover, for many reactions temperature regions are needed which are clearly below the dew point of the environmental air, which in the case of the known installation leads to the precipitation of water of condensation on the metal rail in these temperature regions. This water of condensation on the one hand impairs the temperature transition and, on the other hand, in combination with the suction by application of a partial vacuum, has the result that the support plate as it were "sticks fast" on the metal rail and can be drawn into another temperature region only by high motor outputs.

In the case of the known installation, temperatures below 0° C., such as are required, for example, for stopping enzyme reactions, lead to the formation of ice and thus to very poor temperature transitions and possibly even to the support plate freezing solid.

Furthermore, WO-A-9005023 discloses an installation in which three metal blocks, which are thermally insulated from one another, are placed in series in the longitudinal direction, each metal block being adjustable to its own temperature. A through guide channel, which is open at the top and in which a support plate, which has bores for receiving reaction vessels containing substances to be temperature-controlled, is arranged so that it is moveable in the longitudinal direction, is milled in the metal blocks and in the plastic blocks arranged between them for thermal insulation.

In the case of this installation also, the support plate is pulled with the aid of a toothed belt from one temperature-controlled region into another. Although with this installation the base of the support plate is so large that the support plate does not tend to tip when pulling, the support plate occasionally buffets, during travel, against projecting edges which are produced at the transition from one metal block to a plastic block, or vice versa, because of the different thermal expansion of these materials.

Moreover, when travelling between two temperature regions controlled at very different temperatures, the support plate can, because of the thermal expansion associated with the travel, jam in the channel, which is constructed as a dovetail guide, to such an extent that further transport is impossible.

In both cases the operators must intervene to ensure the further operation of the known installation.

Furthermore, in the case of both installations it is known to use a lubricant, which is intended to ensure that the transport plate slides more readily. However, after several travel operations the metal block arrangement must be re-lubricated, which leads to time-consuming maintenance work in the case of prolonged operation.

The invention, therefore, has for its object to improve an installation and a process of the initially mentioned type with a view to avoiding the disadvantages mentioned above. In particular, it should be possible to change the temperatures of the substances more rapidly, even at relatively low temperatures. Moreover, the installation, having a simple structural design, should be rapid and simple to take into operation and should be maintenance-free during operation.

In respect of the installation mentioned at the outset, this object is achieved by the fact that the pressure-generating device is set up to generate an over-pressure or a partial vacuum as desired and the transport device has an arrangement which can be brought into contact with the support plate in such a way that a shearing force which substantially acts in the direction of the transport path can be exerted on the support plate.

In respect of the process mentioned at the outset, this object is achieved by the fact that, at the start of the transport step, an over-pressure is built up between the outer surface and the metal block arrangement, so that the support plate is at least substantially lifted from the metal block arrangement, that, during the transport step, the support plate is pushed only in the direction of the transport path and that, at the end of the transport step, the overpressure is removed again.

The object on which the invention is based is achieved in full in this way. Because, with the new installation and the new process, an over-pressure is built up between the support plate and the metal block arrangement during transport of the support plate, the support plate as it were floats on a cushion of air over any edges. Since the support plate, on the other hand, is now pushed only in the direction of the transport path, the force being exerted only in the transport direction, tipping, and thus jamming, of the support plate can no longer occur. In this way it is possible very rapidly to push the support plate backwards and forwards between different temperature regions, which results in a substantial reduction in the total time for changing the temperature. The support plate is as it were lifted by a cushion of air from the metal block arrangement, pushed on this cushion of air at high speed into the new temperature region and lowered again in said region.

It is particularly preferred in the case of the illustrative embodiment of the installation if the support plate can be brought into thermal or other contact with the metal block arrangement solely via its bottom surface, which is the at least one outer surface.

This measure has the advantage that the support plate can in no case jam in the metal block arrangement. The only surface via which it can come into contact with the metal block arrangement is its bottom surface, which floats on a cushion of air during the transport operation. Since with the new installation the support plate can no longer become caught, the new installation is maintenance-free and simple to operate. Moreover, the transport speed of the support plate can be further increased in this case, since even at high speeds there is no risk of catching. This contributes to the time required for changing the temperature of the substances moved with said plate becoming even shorter.

Furthermore, it is preferred if the support plate has a thickness, measured between its upper side and the bottom surface, which is small compared with its transverse dimensions.

This measure has the advantage that the transport of heat from the support plate, or into the said plate, can, on the one hand, occur over a large surface and that, on the other hand, the amount of heat to be transported in the support plate itself has to travel only a short path because of the small thickness of said plate. The consequence of this is that the temperature of the support plate, and thus also of the substances contained in the reaction vessels, can be changed very rapidly. Whereas the measures relating to the air cushion and the pushing reduce the transport time, in this case the actual time which is required to carry out the heat exchange itself is reduced. As already mentioned, the total time taken to change temperature is made up of these two times. Since with the new installation both time periods are considerably shortened, the total time taken to change temperature is also very short, so that even enzyme reactions, which require steep temperature profiles as a function of time, can be controlled using the new installation.

Furthermore, it is preferred if the thickness of the support plate is less than 10 mm.

As a result of this measure the heat exchange path in the support plate is advantageously reduced, so that the change in temperature takes place in an even shorter time.

Furthermore, it is preferred if the support plate is made of silver.

This measure has the advantage that a metal is used which has a very high temperature and thermal conductivity—compared with other metals—so that the heat transport takes place very rapidly.

It is further preferred if the receiving device is designed to receive a flexible, thin plastic plate, in which downwardly projecting wells for receiving the substances are constructed.

This measure has the advantage that the heat transfer from the support plate through the wall of the reaction vessel into the substance or solution to be temperature-controlled proceeds within a very short time because of the thin wall of the plastic plate in the region of the wells. Compared with the known plastic reaction vessels, the change in temperature takes place considerably more rapidly in the case of these plastic plates.

Furthermore, it is preferred if the receiving device has recesses adapted to the outer contours of the wells and if the plastic plate can be fixed to the support plate by means of screws.

These measures ensure a very good thermal contact between the support plate on the one hand and the wells of the plastic plate on the other hand. This likewise leads to a rapid, and also reproducible, change in the temperature of the substances.

Furthermore, it is preferred if openings are provided in the bottom surface of the support plate, which openings are joined, via channels running in the support plate, to a connecting branch which is arranged on the support plate and which, in turn, is connected to the pressure-generating device.

This measure has the advantage that the cushion of air is formed directly below the support plate, which is particularly simple from the structural point of view. Moreover, in this case it is possible to use the same openings both for suction using a partial vacuum and for lifting using over-pressure.

Furthermore, it is preferred if the arrangement which can be brought into contact with the support plate has a guide fork which has two guide rods which are parallel to one another and spaced apart and between which the support plate is guided.

This measure has the advantage that because of the "loose" guidance of the support plate no downwardly directed forces are exerted on the latter. Therefore, even a small cushion of air suffices to lift the support plate, at least in regions, from the metal block arrangement. No forces arise which could bring the support plate into contact with the metal block arrangement against the pressure of the air cushion during moving. The operation of the new installation is thus reliably ensured. There is no longer the risk of the support plate tilting or tipping.

Furthermore, it is preferred if the transport device has a slide which is guided, so as to be moveable in the longitudinal direction, on two guide rods which are parallel to one another, a holder carrying the guide fork being detachably fastened to said slide and being connected via a flexible element to the connecting branch, the flexible element being provided at the same time for fixing the support plate transversely to the transport direction.

This measure has the advantage that the support plate is connected via a flexible element, which exerts no transverse forces, to a holder and thus cannot come out of the metal block arrangement at the side. The support plate is held via the holder and the flexible element as it were above the cushion of air. Since the holder is arranged detachably on the slide, the support plate, together with the holder, can be inserted in and removed again from the metal block arrangement in a simple manner. As a result, the new installation can be taken into operation very simply and also by staff with no technical training.

In the case of this illustrative embodiment it is further preferred if the pressure-generating device has a motor fan with a pressure outlet and suction inlet and also a vented reversing valve.

This measure has the advantage that only the reversing of the valve has to be triggered in order to switch from suction to lifting and vice versa. In this way, the new installation is of very simple structural design. Moreover, the switching between air cushion and suction takes place with virtually no delay, which also contributes to shortening the time for changing the temperature.

Furthermore, it is preferred if, in the case of an installation in which at least two regions adjustable to a particular temperature, which can be pre-determined, are provided, a drying device is provided for each region having a temperature in the vicinity of the dew point or lower, said drying device feeding into the particular region a gas having a low moisture content.

In this structurally very simple manner, the formation of water of condensation in these temperature regions is prevented. Moreover, the formation of ice can be prevented in this way. Drying with gas consequently prevents all of the disadvantages described above in connection with the formation of water of condensation or ice. This measure, therefore, also contributes to a reproducible and rapid change of temperature and, on the other hand, makes possible temperature regions which are substantially below the dew point at the ambient temperature.

In the case of this illustrative embodiment, it is preferred if the gas is dried nitrogen gas.

This measure has the advantage that a gas is used which is simple to dry and inexpensive and which also occurs in the ambient atmosphere and is non-toxic. Therefore, no special precautionary measures have to be taken in the new installation, which also contributes to a structurally simple construction.

Furthermore, it is preferred if the metal block arrangement has a heat rail having a plane surface which can be brought into thermal contact with the likewise plane bottom surface of the support plate.

This measure has the advantage that the heat transfer between the two plane surfaces is very rapid, which contributes to shorter times for changing the temperature.

Furthermore, it is preferred if the metal block arrangement has a lid which is hollow in its interior and which covers the surface and leaves free only a slit which runs in the longitudinal direction of the metal block arrangement and is open at the side transversely to the longitudinal direction and into which the guide fork protrudes from the outside, and if the drying device is arranged in the lid.

As a result of this measure, dry gas is prevented, in an advantageous manner, from issuing very rapidly from the particular temperature region and being replaced by ambient air having a high moisture content. In other words, the lid and the dry gas blown in provide a closed internal atmosphere, the moisture content of which is so low that there is no precipitation of moisture or even ice formation, even on metal surfaces at temperatures below the dew point. Consequently it is possible to extend the temperature region to even lower values, so that even temperatures which are as low as are required for freezing, for example, biochemical solutions are achieved. This makes the new installation also usable for test procedures in which, following a series of temperature profile cycles, the solutions or substances treated in this way must be frozen at temperatures below 0° C., such as, for example, in the case of the polymerase chain reaction (PCR).

Furthermore, it is preferred if the heat rail is made of metal, preferably aluminium, throughout and is temperature-controlled at its ends.

This measure, which is known per se, leads to a linear temperature gradient being established, so that the number of temperature regions available is determined solely by the travel accuracy of the transport plate. The transport plate in each case assumes the temperature value prevailing at the location in the metal rail above which the center line of the support plate is arranged.

Furthermore, it is preferred if an additional temperature control, which can be shut off, is provided approximately centrally between the ends of the heat rail.

This measure has the advantage that, in order to build up the temperature gradient, heat can be supplied or removed via the additional temperature control, so that the new installation can be taken into operation very rapidly. When the temperature gradient has been approximately established, the additional temperature control is switched off, so that the gradient is determined solely by the temperature control devices provided at the ends of the metal rail. Consequently, control of the gradient is very simple.

Furthermore, it is preferred if the heat rail has alternate, temperature-controllable metal blocks and insulating blocks provided in sequence in the longitudinal direction.

As a result of this measure, which is likewise known, it is possible to provide relatively large regions which are set to a constant and precisely controllable temperature, so that the temperature adjustment of the substances is not limited by the positioning accuracy of the support plate in the heat rail. The temperature which is established in the substances is determined only by the temperature of the particular metal block. This temperature, however, can be set very accurately via the external temperature-control devices.

The process according to the invention can advantageously be carried out using the new installation.

Further advantages are apparent from the description and the appended drawing.

Of course, the features which have been indicated above and which are still to be explained below can be used not only in the particular combinations indicated but also in other combinations or on their own, without departing from the scope of the present invention.

An illustrative embodiment of the invention is shown in the drawing and is explained in more detail in the description which follows. In the drawing.

Figure 1:
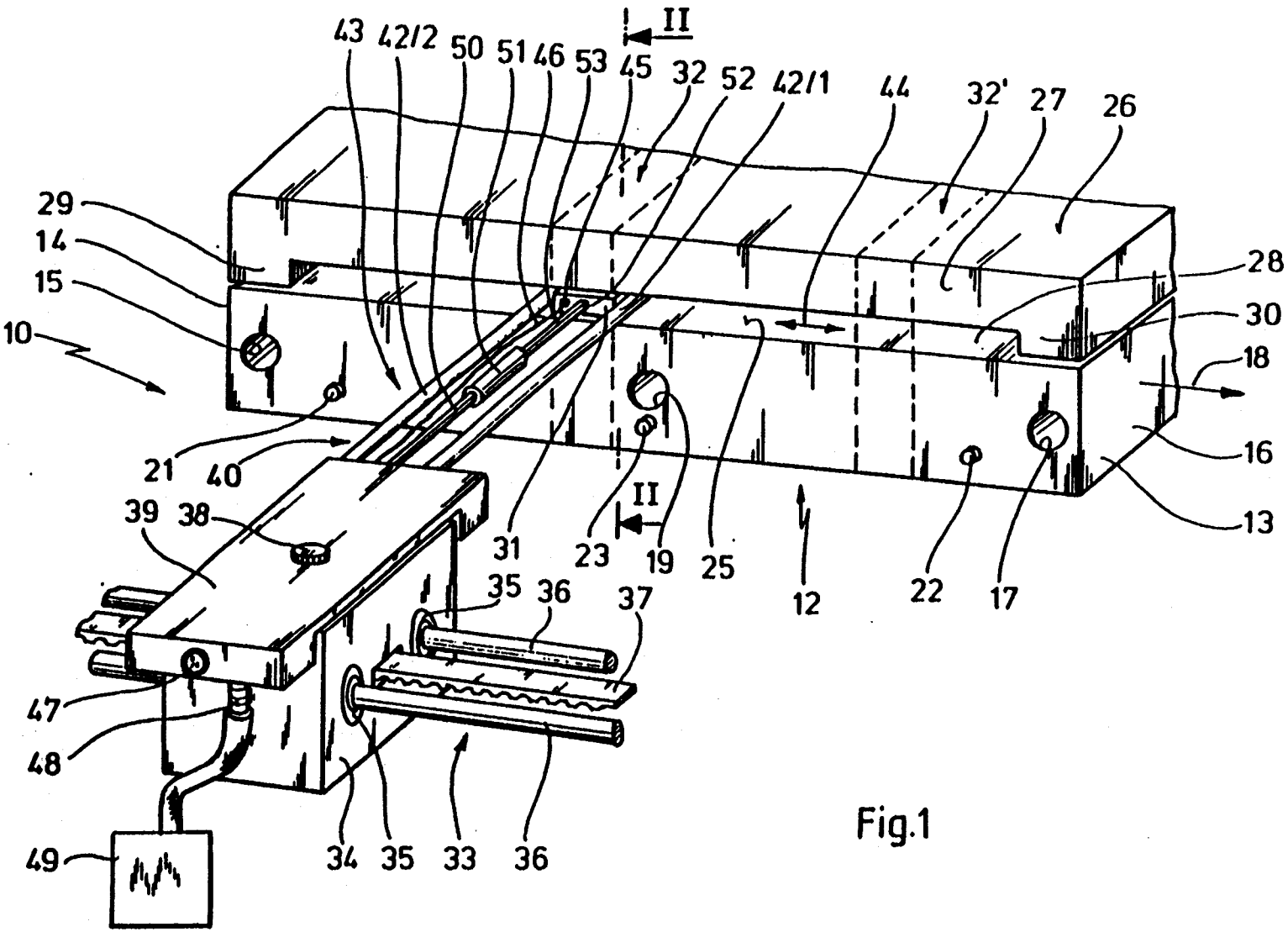
FIG. 1 shows a diagrammatic representation of a first illustrative embodiment of the installation according to the invention in a partially cut-away and perspective view.

In FIG. 1 10 denotes an installation for the temperature control of chemical and/or biochemical and/or microbiological substances.

The installation 10 has a metal block arrangement 12, which embraces an elongated heat rail 13, which preferably is made in one piece from an aluminium block. The heat rail 13 has a bore 15 at its left-hand end 14, a bore 17 at its right-hand end 16 and a further bore 19 approximately centrally between the bores 15 and 17 in its longitudinal direction 18. The bores 15, 17 and 19 serve to connect the heat rail 13, for example, to liquid thermostats, or to receive heating cartridges. In this way a temperature gradient, which can be adjusted as desired and runs in the longitudinal direction 18, is produced in the heat rail 13.

Three temperature probes 21, 22 and 23, which are assigned to the bores 15, 17 and 19, are provided for monitoring the temperature gradient. The arrangement can, for example, be such that the distance between the temperature probe 21 and the temperature probe 22, measured in the longitudinal direction 18, is precisely 100 cm, whilst the temperature difference between the temperature probes 21 and 22 is, for example, 100° C. In this case, the temperature probe 23 indicates precisely 50° C. In this illustrative embodiment, a heating cartridge, which is set at 48° C., is inserted in the bore 19. If the heat rail 13 is to be taken into operation, cold coolant at −10° C. is passed through the bore 15, while the bores 17 and 19 are fitted with heating cartridges which are set at 110° C. and 48° C. respectively.

The heating cartridge inserted in the bore 19 serves only to accelerate the heating-up operation of the heat rail 13. When the temperature gradient along the direction 18 has been established, the temperature which is indicated by the temperature probe 23 is, as stated, 50° C., so that the heating cartridge located in the bore 19 is no longer triggered.

The heat rail 13 has a plane surface 25, which is covered by a lid 26. The lid 26 has a U-shaped opening in its front face 27 and, with the heat rail 13, delimits a longitudinal slit 28 which runs in the longitudinal direction 18 and is open at the side. The longitudinal slit 28 is delimited in the longitudinal direction 18 by a left-hand leg 29 and a right-hand leg 30 of the lid 26. The lid 26 lies with its legs 29 and 30 directly on the surface 25 of the heat rail 13.

A support plate 31 is guided, so as to be moveable longitudinally, in the longitudinal slit 28 as shown in FIG. 1 and is arranged in a temperature region 32, which in the illustrative embodiment shown is just below 50° C. The temperature which the support plate 31 assumes as a result of contact with the surface 25 corresponds to the average temperature prevailing in the temperature region 32. The width of the temperature region 32, measured in the longitudinal direction 18, precisely corresponds to the width of the support plate 21 or is actually defined by this.

If, for example, the lower temperature in the temperature region 32, which is at the side of the left-hand end 14, is 45° C. and the upper temperature, which is at the side of the right-hand end 16, is 47° C., the average temperature in the temperature region 32, and thus the temperature assumed by the support plate 31, is 46° C.

A transport device 33 is provided in order to move the support plate 31, for example into a further temperature region indicated at 32'. The transport device 33 has a slide 34, which is guided via spherical liners 35 and so that it is moveable longitudinally on two guide rods 36 which are parallel to one another and spaced apart. The guide rods 36 are parallel to the longitudinal direction 18 of the heat rail 13.

A toothed belt 37, which is fed over deflection pulleys, which are not shown, to a toothed wheel which is driven by a controllable motor, is fastened to the slide 34. In a known manner, the slide 34 can be moved backwards and forwards in the longitudinal direction 18 via the toothed belt 37. The slide 34 is guided on two guide rods 36 so that the slide 34 can not tilt or jam when travelling.

A holder 39 is screwed onto the top of the slide 34 with the aid of a knurled nut 38, which holder 39, via an arrangement indicated at 40, exerts a shearing force in the longitudinal direction 18 on the support plate 31. For this purpose, the arrangement 40 has two guide rods 42, which are parallel to one another and spaced apart and constitute a guide fork 43, in which the support plate 31 is guided. The arrangement is such that the support plate 31, viewed in the longitudinal direction 18, is loosely fixed by the guide rods 42 and moveable in the direction of a transport path indicated at 44.

For monitoring, a temperature probe, indicated at 45, which is connected via a cable 46 to a connector 47, which is located on the holder 39, is provided on the support plate 31. A temperature measuring device, which indicates the actual temperature in the support plate 31, can be connected to the connector 47 in a known manner.

In the vicinity of the connector 47, a connection piece 48 is provided on the holder 39, which connection piece faces upwards and is connected to a pressure-generating device 49, which is indicated at 49 and will be described in more detail. The pressure-generating device 49 serves to supply the support plate 31 with over-pressure or partial vacuum. For this purpose, the pressure-generating device 49 is connected, via channels provided in the holder 39 and not shown in FIG. 1, with a hollow needle 50, which faces in the direction of the slit 28 and is likewise attached to the holder 39. The hollow needle 50 is connected via a flexible tube 51 to a further hollow needle 52, which is arranged on the support plate 31 and serves as connecting branch 53 for the compressed air or suction air.

As can be seen in FIG. 1, the guide rods 42 project into the longitudinal slit 28. In addition, the guide rods 42 are parallel to the surface 25 of the heat rail 13, so that when the slide 34 travels in the longitudinal direction 18 the guide rods 42 are moved backwards and forwards in the slit 28 without jamming.

Figure 2:
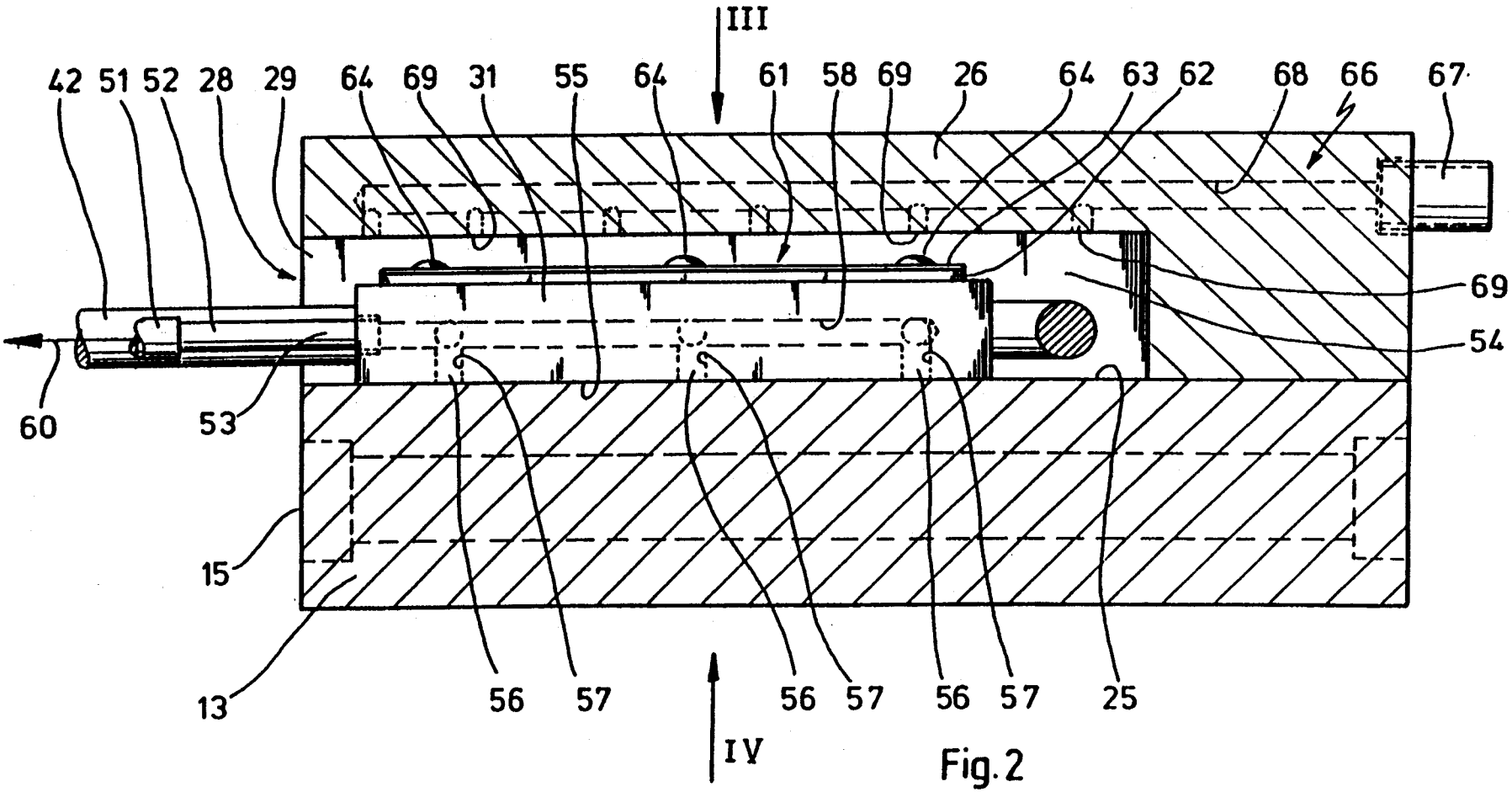
FIG. 2 shows a sectional view of the installation from FIG. 1, along the line II—II from FIG. 1, with the support plate under suction.

FIG. 2 shows the metal block arrangement 12 in cross-section, so that the support plate 31 arranged in the interior 54 of the arrangement can be seen.

As can be seen, the plane bottom surface 55 of the support plate 31, which is made of silver, lies directly on the likewise plane surface 25 of the heat rail 13. Openings 56, which face downwards and are connected via channels 57 and 58 to the hollow needle 52, are provided in the bottom surface 55. In the operating condition shown in FIG. 2, the pressure-generating device 49 is switched to suction operation, the suction direction being indicated by an arrow 60.

The bottom surface 55 of the support plate 31 is thus sucked against the upper side 51, as a result of which a very good thermal contact is produced between the heat rail 13 and the support plate 31.

On its upper side 61, which is remote from the bottom surface 25, the support plate 31 carries a flexible plastic plate 62, which is covered by a lid 63 and screwed onto the support plate 3t by means of screws 64. The plastic plate 62, which is still to be described in more detail, has depressions for the substances to be temperature-controlled.

A drying device 66, which is supplied with dried nitrogen gas from the outside, via a pipe connection indicated at 67, is provided in the left-hand arm 29 of the lid 26, which arm can be seen behind the support plate 31 in FIG. 2. The gas passes through the pipe connection 67 into a bore 68, which runs transverse to the longitudinal direction 18 and from which, in turn, branch bores 69 branch downwards, which lead into the interior 54 of the metal block arrangement 12.

In this way an atmosphere of dried nitrogen gas is produced in the left-hand region of the metal block arrangement 12, in which temperatures below the dew point, i.e. below about 15° C., prevail. This prevents water of condensation or even ice from forming on the surface 25 of the heat rail 13.

Since the lid 26 completely covers the surface 25 and only the laterally open slit 28 is open to the ambient atmosphere, the exchange of air between the outside atmosphere and the interior 54 of the metal block arrangement 12 is slight. Since, moreover, a slight overpressure is generated in the interior 54 by the nitrogen gas blown in, no moist air can pass into the interior 54. The formation of water of condensation and ice is thus completely prevented.

Figure 3:
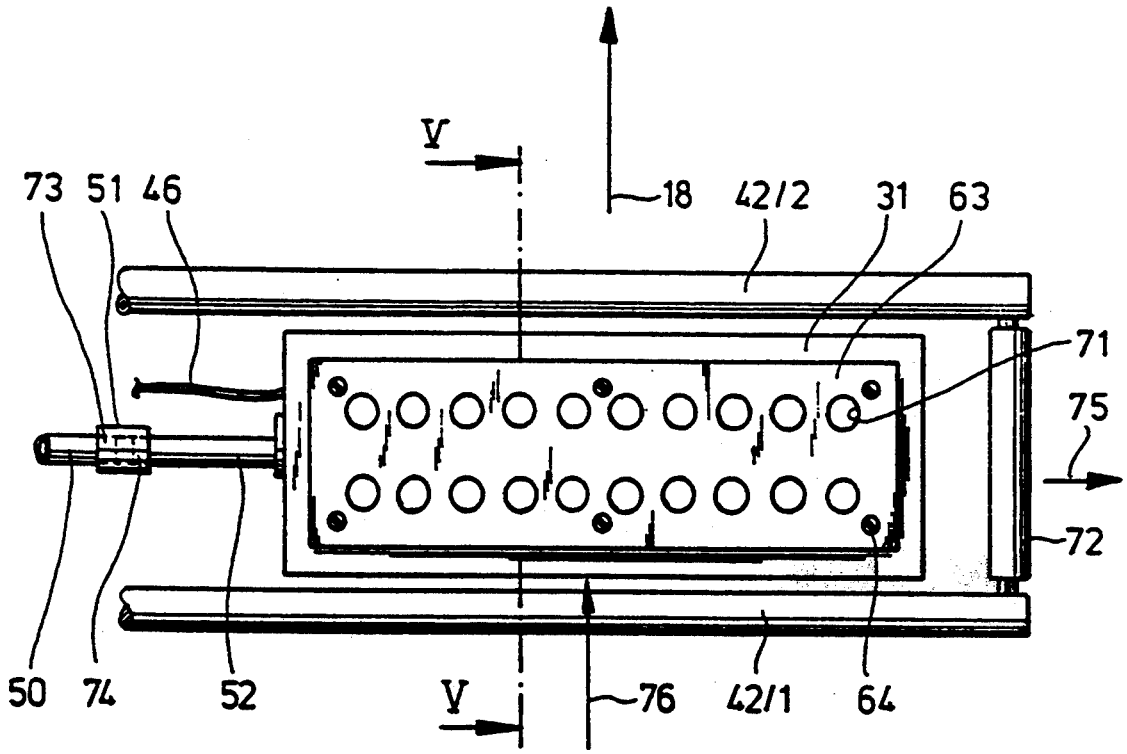
FIG. 3 shows a top view of the support plate from FIG. 2, along the line III from FIG. 2, partially cut-away.

In FIG. 3 the support plate 31 is shown in a view from above, so that the flexible plastic plate 62 and the lid 63 covering said plate can be seen. Two rows each of 10 wells 71, in which the substances or solutions to be temperature-controlled are placed, are provided in the plastic plate 62.

The two guide rods 42 are joined to one another at their free ends by a transverse rod 72. By means of the transverse rod 72, the guide rods 42 are held parallel to one another, so that the support plate 31 cannot jam between them.

It can also be seen from FIG. 3 that the hollow needles 50 and 52 are fixed by the flexible tube 51 in such a way that a small distance remains between their front ends 73 and 74 respectively. In this way, the support plate 31 is on the one hand fixed in the direction indicated at 75 transversely to the longitudinal direction 18, but on the other hand can be swung horizontally to a certain extent relative to the hollow needle 50. The flexible tube 51 is so chosen that only low, or no, restoring forces are exerted on the support plate 31 when the support plate 31 is lifted from the surface 25.

When the slide 34 moves in the longitudinal direction 18, the guide rods 42 move in the same direction and carry with them the support plate 31 arranged between them. In the example shown in FIG. 3, the lower guide rod 42/1 comes into contact with the support plate 31 and exerts on the latter a shearing force indicated at 76. The shearing force 76 has, at least predominately a component in the longitudinal direction 18, a force component which presses the support plate 31 onto the upper side 25 of the heat rail 13, is not exerted.

Figure 4:
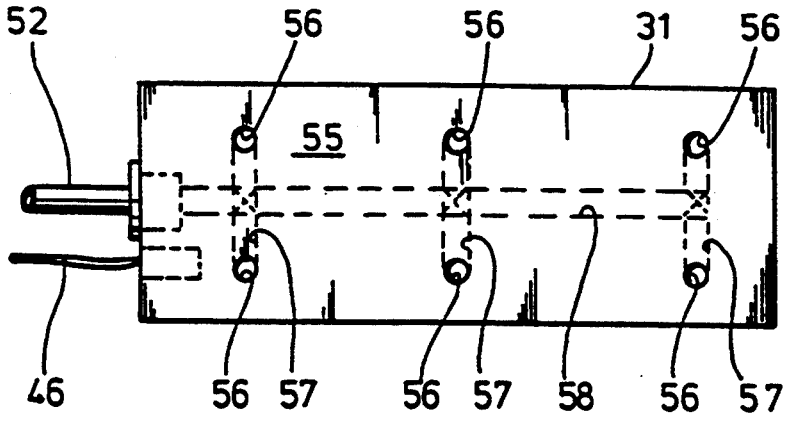
FIG. 4 shows a bottom view of the support plate from FIG. 3, in a view along the arrow IV from FIG. 2.

In FIG. 4 the support plate 31 is shown in a view from below in which it can be seen that the openings 56 are arranged in pairs. Each pair is joined to one another by a transverse channel 57, whilst the channels 57 are all open to the hollow needle 52 via a longitudinal channel 58. In this way, air introduced via the hollow needle 52 is uniformly distributed over the six openings 56 and flows via these out of the bottom surface 55 of the support plate 31.

Figure 5:
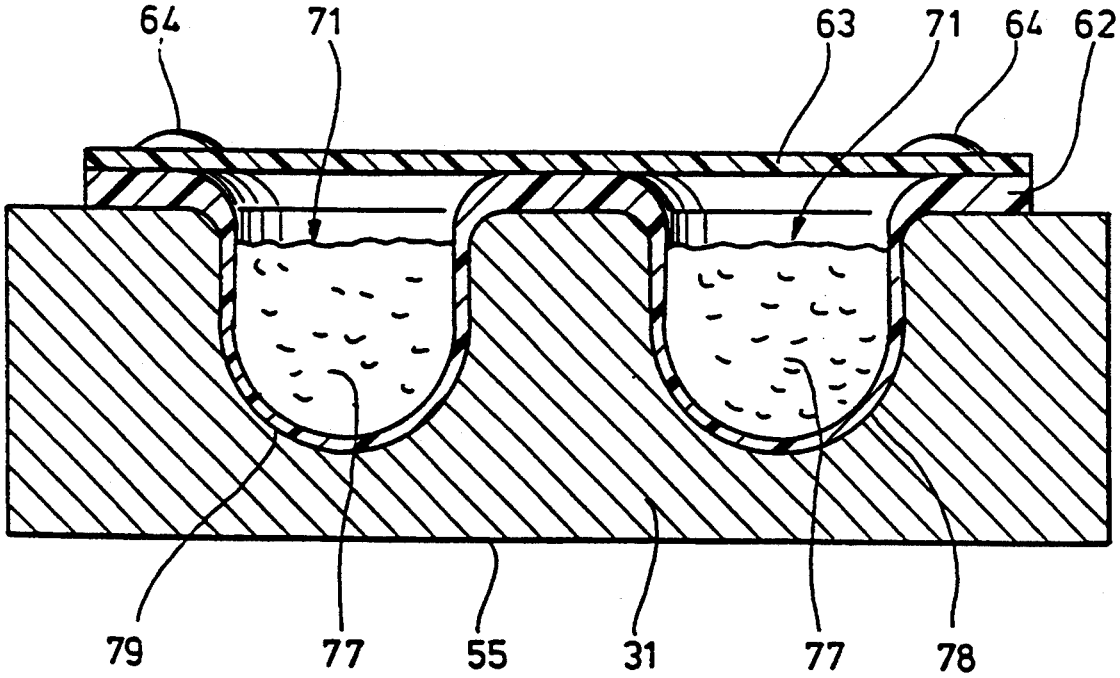
FIG. 5 shows a sectional view of the support plate from FIG. 3, along the line V—V from FIG. 3.

In FIG. 5 the support plate 31 is shown in cross-section, so that the substances 77 placed in the wells 71 of the plastic plate 62 can be seen. The wells 71 are located in precise-fit recesses 78, which serve as receiving device 79. Since the wells 71 lie very tightly against the recesses 78, a good heat transfer from the support 31, which is made of silver, through the thin wall of the wells 71 into the substances 77 is ensured. The substances 77 therefore very rapidly assume the temperature of the support plate 31. The support plate 31 itself is temperature-controlled, via its bottom surface 55, from the surface 25 of the heat rail 13.

The pressure-generating device 49 will now be described in more detail with reference to FIG. 6. The pressure-generating device 49 comprises a motor fan 80, the suction inlet of which is connected via a tube 81 to a reversing valve 82. Via a further tube 83, the pressure outlet of the motor fan 80 is also connected to the reversing valve 82. The reversing valve 82 has a vent inlet or vent outlet 84 and is connected, by its fourth connection, via a connection tube 85, in a manner which is not shown, to the connection piece 48 of the holder 39.

A rotatable angle tube 87, via which the connection tube 85 can be connected to the tube 81 and thus to the suction inlet of the motor fan 80, or to the tube 83, and thus to the pressure outlet of the motor fan 80, as desired, is provided in the reversing valve 82.

Figure 6A:
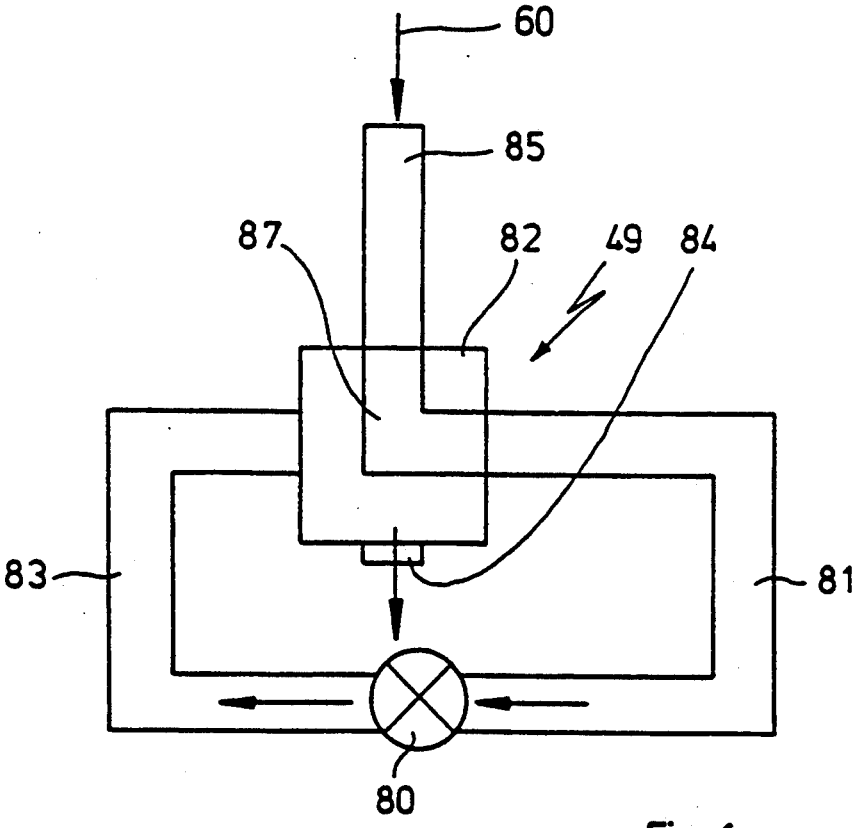
FIG. 6 shows a diagrammatic representation of the pressure-generating device from FIG. 1, in both the suction setting and the pressure setting.

In suction operation, which is shown in FIG. 6*a*, the motor fan 80 sucks air in through the connection tube 85, which air is fed through the tube 81 and then through the tube 83 and leaves the reversing valve 82 through the vent outlet 84.

Figure 6B:
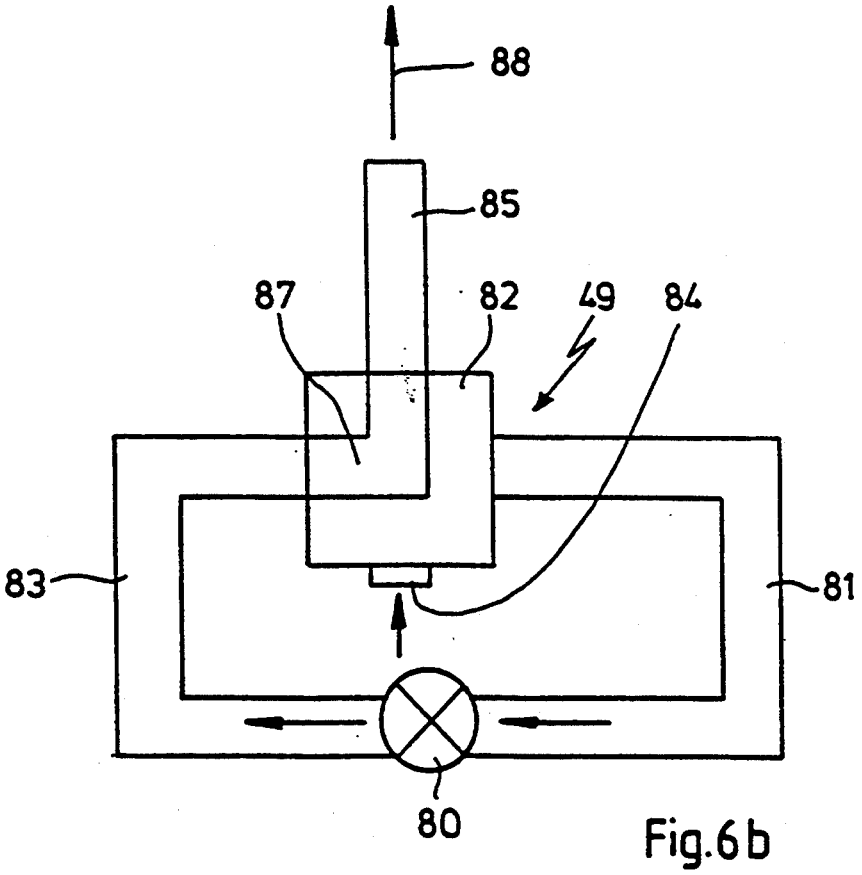

Pressure operation, in which the motor fan 80 draws in air through the vent inlet 84 and passes it through the tube 83 into the connection tube 85, is shown in FIG. 6*b*.

In this way the motor fan 80 can be in continuous operation; for switching from pressure operation to suction operation it is necessary only to control the reversing valve 82 in such a way that the angle tube 87 tilts into the particular other direction.

Figure 7:
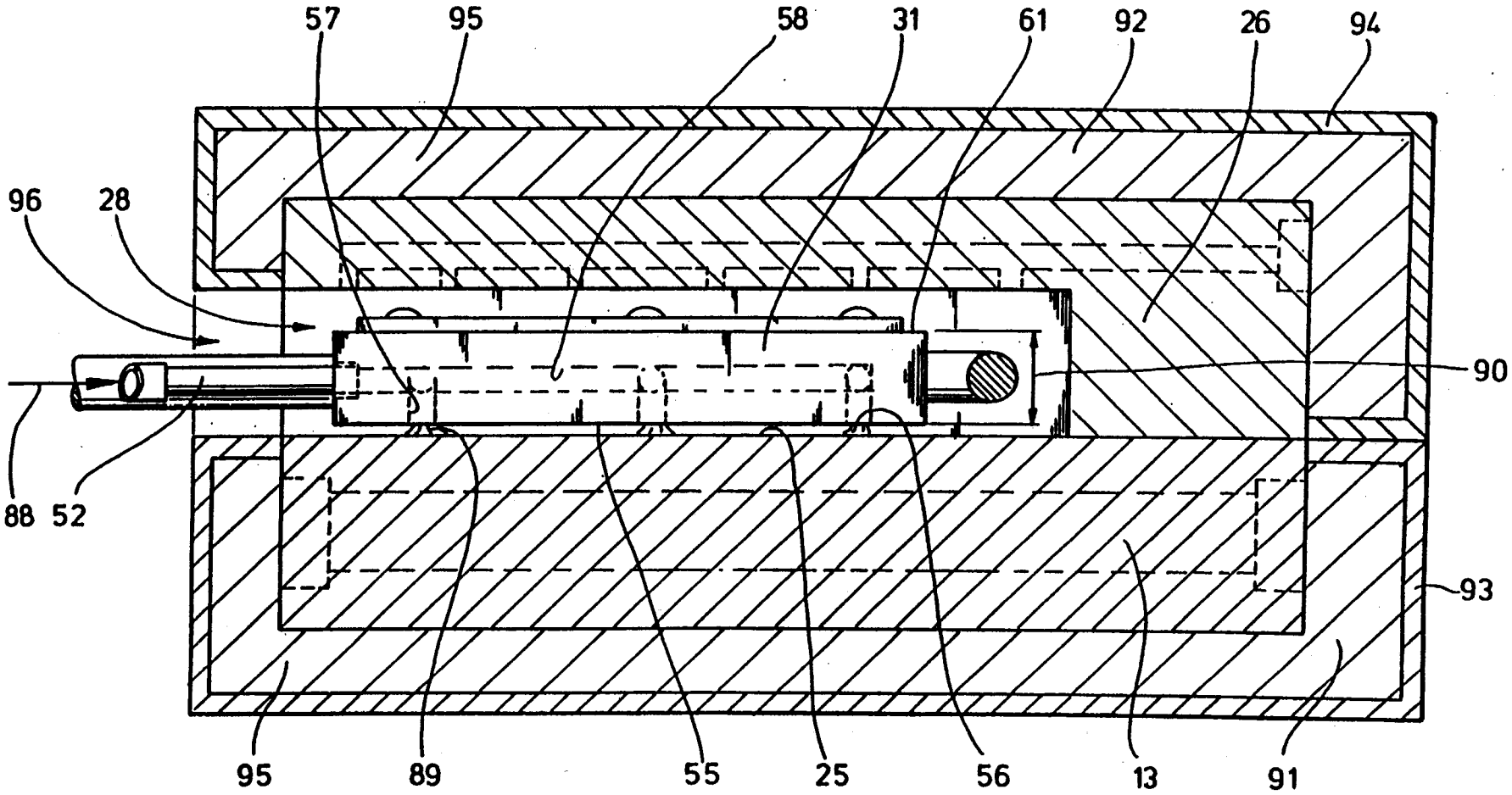
FIG. 7 shows a view as in FIG. 2, but with the support plate raised, in which an insulation which surrounds the metal arrangement is shown diagrammatically.

Whereas in FIG. 2 the support plate 31 is sucked against the surface 25, in FIG. 7 the operating condition is shown in which the pressure-generating device 49 is in pressure operation, which is shown in FIG. 6*b*. Air is fed, through the pressure direction indicated at 88, via the connection piece 48 and the hollow needles 50 and 52 into the channel 58 and from the latter via the channels 57 through the openings 56. The air issuing from the openings 56 lifts the support plate 31 from the surface 25 and produces an air cushion, which is indicated at 89 and on which the support plate 31 floats, between the bottom surface 55 and the surface 25. The support plate 31 lifted in this way can now be moved in the longitudinal direction 18 without frictional forces having to be overcome or there being a risk of the support plate 31 tilting in the interior 54. When the support plate 31 is in the floating state shown in FIG. 7, this plate has no contact whatsoever with the metal block arrangement 12.

The support plate 31 has a thickness, measured between its upper side 61 and its bottom surface 55, which is indicated at 90 in FIG. 7. The thickness 90 of the support plate 31 is small compared with the transverse dimensions of the support plate 31. Therefore, a large bottom surface 55 is available, over which the support plate 31 either floats on the air cushion 89 or, alternatively, is in thermal contact with the surface 25.

In FIG. 7 it can also be seen that the heat rail 13 is surrounded by an insulating housing 91 and the lid 26 is surrounded by an insulating lid 92. The insulating housing 91 has a thin metal wall 93, whilst the insulating lid 92 also comprises a thin metal wall 94. The metal walls 93 and 94 delimit the insulating housing 91 and the insulating lid 92 respectively towards the outside and incorporate in their interior a suitable insulating material, which, for example, can be rock wool and Styropor. For reasons of clarity, the insulating housing 91 and insulating lid 92 are not shown in FIGS. 1 and 2. However, for flawless operation of the installation 10 it is necessary to insulate said installation thermally against the outside in order to be able to establish a temperature gradient which is as linear as possible.

As can also be seen in FIG. 7, the insulating lid 92 leaves a slit 96 open, which corresponds to the slit 28.

To take the installation 10 into operation, the knurled nut 38 is loosened and the holder 39, with the guide fork 43 and the support plate 31, is moved from the slit 28. While, as described above, the temperature gradient in the heat rail 13 is being established, the plastic plate 62 can be loaded with the substances 77 and covered with the lid 63. The plastic plate 62 is then screwed firmly, with the aid of the screws 64, onto the support plate 31 in such a way that a close thermal contact is produced between the recesses 78 and the wells 71. When the temperature gradient has been established in the heat rail 13, the support plate 31 is pushed laterally into the slit 28 and the holder 39 is again fastened to the slide 34 with the aid of the knurled nut 38. The pressure-generating device 49 is now connected to the connection piece 48 and the slide 34 is run into the starting position for the support plate 31.

The motor fan 80 is then switched on and the reversing valve 82 set for suction operation. By this means the support plate 31 is sucked against the surface 25 and thus comes into thermal contact with the heat rail 13. The support plate 31 assumes the temperature of the selected temperature region 32 within a few seconds. The same applies for the substances 77.

The support plate 31 remains in the temperature region 32 for a fixed period. The reversing valve 82 is then switched over, so that the support plate 31 is lifted from the surface 25 by the air cushion 89 produced. The support plate 31, which is now floating, is moved, for example in the longitudinal direction 18 to the temperature region 32'. During this operation the guide fork 43, via its guide rod 42/2, pushes the support plate 31 without exerting a force against the air cushion. Once the temperature region 32' has been reached, the reversing valve 82 switches to suction operation again and the support plate 31 is sucked against the surface 25.

The transport of the support plate 31 accordingly takes place without any contact with the metal block arrangement 12, so that lubricants of all types can be dispensed with. The movement of the support plate 31 also takes place within a period measured in seconds.

Since a temperature probe 45 is provided in the support plate 31 the actual temperature prevailing in the support plate 31 can be monitored continually. Very precise adjustment of the temperature gradient in the heat rail 13 is therefore not required. Should it be found that the selected temperature region 32' does not have the desired temperature, the support plate 31 can be moved to lower or higher temperatures within a very short time, until the correct temperature has been reached.

Figure 8:
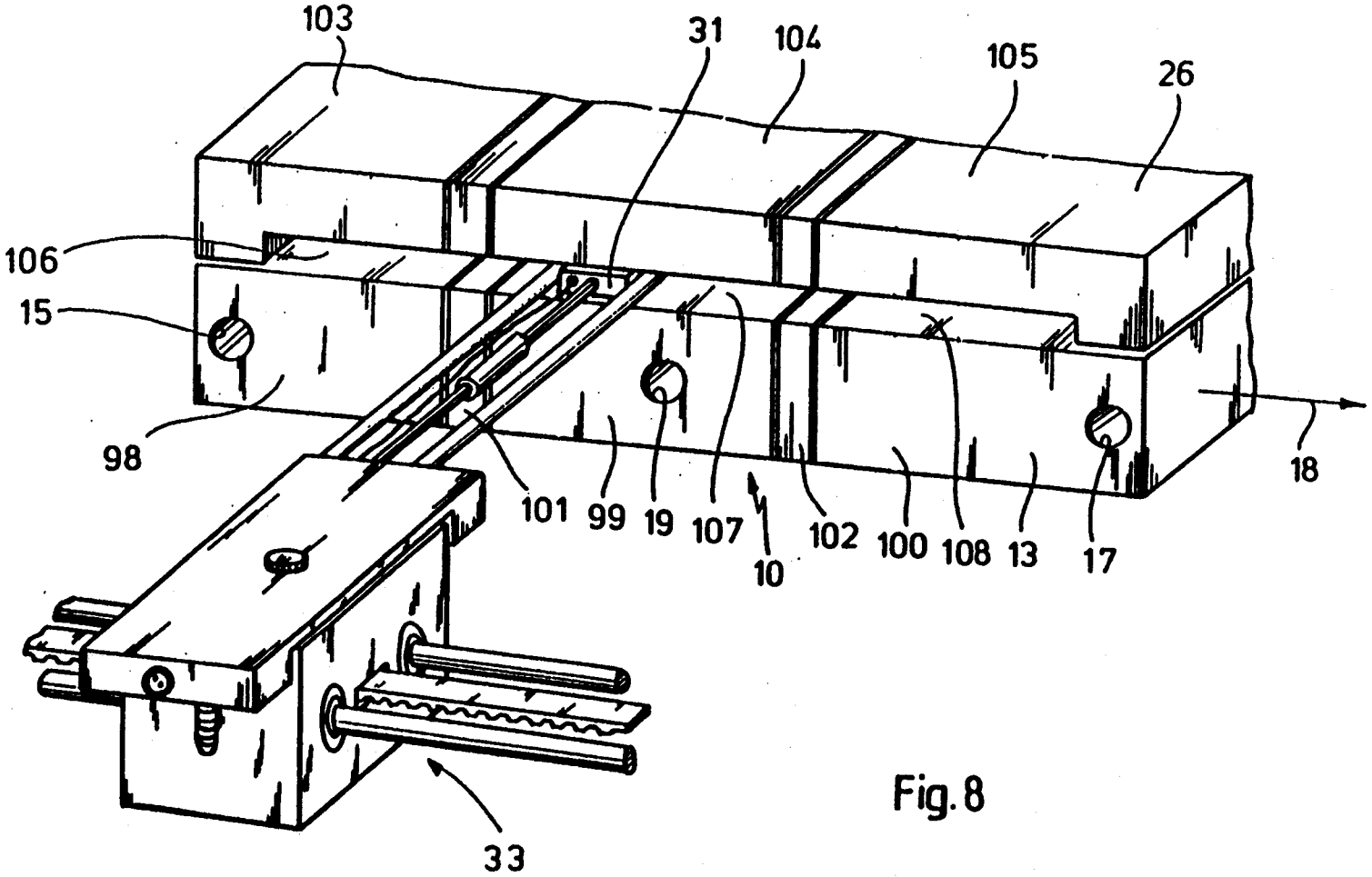
FIG. 8 shows a second illustrative embodiment of the new installation, in a representation as in FIG. 1.

FIG. 8 shows a further illustrative embodiment of the invention, in which the heat rail 13 consists of a succession of three metal blocks 98, 99 and 100, an insulating block 101 and 102 respectively being arranged between each two blocks. Each metal block 98, 99 and 100 is assigned its own lid section 103, 104 and 105. In this illustrative embodiment the metal blocks 98, 99 and 100 are in each case set to a uniform temperature and thus constitute temperature regions 106,107 and 108.

We claim:

1. An installation for the temperature control of chemical and/or biochemical and/or microbiological substances, comprising:

a metal block arrangement having at least one region which can be set to a predetermined average temperature, as well as at least one further region;

a metal support plate means having a receiving device for receiving said substances or for receiving vessels provided for said substances, said support plate means being adapted to be brought into thermal contact via at least one of its outer surfaces with said metal block arrangement;

a transport device for transporting said support plate means along a transport path defining a longitudinal direction into one of said regions of said metal block arrangement, said transport device having an arrangement which can be brought into contact with said support plate means for exerting a shearing force on said support plate means, said shearing force acting substantially in the direction of said transport path; and a pressure-generating device adapted for generating an over-pressure between said at least one outer surface of said support plate means and said metal block arrangement at the beginning of a transporting step, and for generating a partial vacuum between said at least one outer surface of said support plate means and said metal block arrangement at the end of said transporting step.

2. The installation according to claim 1, wherein said support plate means has a bottom surface comprising said at least one outer surface, whereby said bottom surface can be brought into thermal or other contact with said metal block arrangement.

3. The installation according to claim 2, wherein openings are provided in said bottom surface of said support plate means, which openings are joined, via channels running in said support plate means, to a connecting branch which is arranged on said support plate means and which, in turn, is connected to said pressure-generating device.

4. The installation according to claim 3, wherein said arrangement of said transport device comprises a guide fork means having two guide rods, which guide rods are parallel to one another and spaced apart, said support plate means being guided between said guide rods.

5. The installation according to claim 4, wherein said transport device comprises a slide member which is guided, so as to be moveable in said longitudinal direction, on two additional guide rods which are parallel to each other, a holder means carrying said guide fork, said holder means being detachably fastened to said slide member and being connected via a flexible element to said connecting branch, said flexible element being provided further for fixing said support plate means transversely to said transport direction.

6. The installation according to claim 1, wherein said support plate means has a thickness, measured between its upper side and said bottom surface, which is small compared with its transverse dimensions.

7. The installation according to claim 6, wherein said thickness of said support plate means is less than 10 mm.

8. The installation according to claim 6, wherein said support plate means is made of silver.

9. The installation according to claim 1, wherein said receiving device is designed to receive a flexible, thin plastic plate, in which downwardly projecting wells for receiving said substances are constructed.

10. The installation according to claim 9, wherein said receiving device has recesses adapted to the outer contours of said wells and wherein said plastic plate can be fixed on said support plate means by fastening means.

11. The installation according to claim 1, wherein said pressure-generating device comprises a motor fan having a pressure outlet and a suction inlet, and a vented reversing valve.

12. The installation according to claim 1, wherein at least two regions adjustable to a particular temperature, which can be predetermined, are provided, and further wherein a drying device is provided for each region having a temperature in the vicinity of the dew point or lower, said drying device feeding into said particular region a gas having a low moisture content.

13. The installation according to claim 12, wherein said gas comprises dried nitrogen gas.

14. The installation according to claim 1, wherein said at least one outer surface of said support plate means comprises a plane bottom surface and further wherein said metal block arrangement comprises a heat rail member having a plane surface which can be brought into thermal contact with said plane bottom surface of said support plate means.

15. The installation according to claim 14, wherein said metal block arrangement further comprises a lid means, said lid means being hollow in its interior, covering said plane surface of said heat rail member and leaving free only a slit running in said longitudinal direction of said metal block arrangement and being open at the side transversely to said longitudinal direction, said guide fork means protruding from the outside into said slit, said drying device being arranged in said lid means.

16. The installation according to claim 15, wherein said heat rail member is made of metal throughout and is at its ends connected to respective temperature-controlling devices.

17. The installation according to claim 16, wherein an additional heater, which can be shut off, is provided and connected approximately centrally between said ends of said heat rail member.

18. The installation according to claim 15, wherein said heat rail member comprises alternate, temperature-controllable metal blocks and insulating blocks provided in sequence in said longitudinal direction.

19. A process for the temperature control of chemical and/or biochemical and/or microbiological substances, comprising the steps of:

a) setting at least one region of a metal block arrangement to a predetermined temperature;

b) placing said substances or vessels containing said substances in at least one recess provided in a metal support plate means, said support plate means having an outer surface that is adapted to be brought into thermal contact with said metal block arrangement;

c) generating an overpressure between said outer surface of said support plate means and said metal block arrangement for lifting said support, plate means off said metal block arrangement at least over its greatest part;

d) transporting said support plate means along a transport path into the at least one region of said metal block arrangement by pushing said support plate means only in the direction of said transport path;

e) removing said overpressure at the end of said transporting step; and f) generating a partial vacuum between said outer surface of said support plate means and said metal block arrangement in order to improve thermal contact.

20. An installation for the temperature control of chemical and/or biochemical and/or microbiological substances, comprising:

a metal block arrangement having at least one region which can be set to a predetermined average temperature, as well as at least one further region;

a metal support plate means having a receiving device for receiving said substances or for receiving vessels provided for said substances, said support plate means being adapted to be brought into thermal contact via at least one of its outer surfaces with said metal block arrangement, and wherein said support plate means has a bottom surface comprising said at least one outer surface, whereby said bottom surface can be brought into thermal or other contact with said metal block arrangement and further, wherein said support plate means has a thickness, measured between its upper side and said bottom surface, which is small compared with its transverse dimensions;

a pressure-generating device for generating a pressure deviating from the ambient pressure between said at least one outer surface of said support plate means and said metal block arrangement, said pressure generating device being adapted for generating an over-pressure or a partial vacuum; and a transport device for transporting said support plate means along a transport path defining a longitudinal direction into one of said regions of said metal block arrangement, said transport device having an arrangement which can be brought into contact with said support plate means for exerting a shearing force on said support plate means, said shearing force acting substantially in the direction of said transport path.

* * * * *